US010918933B2

(12) United States Patent
Kowalsky

(10) Patent No.: US 10,918,933 B2
(45) Date of Patent: Feb. 16, 2021

(54) ATHLETIC SUPPORT GLOVE

(71) Applicant: Jonathan Kowalsky, West Hollywood, CA (US)

(72) Inventor: Jonathan Kowalsky, West Hollywood, CA (US)

( * ) Notice: Subject to any disclaimer, the term of this patent is extended or adjusted under 35 U.S.C. 154(b) by 281 days.

(21) Appl. No.: 15/052,287

(22) Filed: Feb. 24, 2016

(65) Prior Publication Data

US 2017/0239553 A1 Aug. 24, 2017

(51) Int. Cl.

*A63B 71/00* (2006.01)
*A63B 71/14* (2006.01)
*A41D 19/015* (2006.01)

(52) U.S. Cl.

CPC ..... *A63B 71/141* (2013.01); *A41D 19/01547* (2013.01); *A41D 19/01558* (2013.01); *A41D 19/01582* (2013.01); *A41D 2300/50* (2013.01); *A41D 2600/10* (2013.01)

(58) Field of Classification Search

CPC ..... A63B 71/141; A41D 19/01547; A41D 19/01558; A41D 19/01582; A41D 2300/50

See application file for complete search history.

(56) References Cited

U.S. PATENT DOCUMENTS 1,378,758 A 5/1921 Baskin
2,113,934 A 4/1938 Denkert
2,751,598 A 6/1956 Romeo
2,884,644 A 5/1959 Jefferson
2,928,102 A 3/1960 Canausa
2,975,429 A * 3/1961 Newman ..... A63B 71/146 2/161.2
3,037,209 A * 6/1962 Applegate, Jr. ..... A63B 71/148 2/20
3,224,012 A * 12/1965 Hamm ..... A63B 71/148 2/161.1
3,394,408 A * 7/1968 Bush ..... A63B 71/146 2/159
3,544,111 A * 12/1970 Kluber ..... A63D 15/006 473/43
3,740,766 A 6/1973 Kobylarz
4,295,229 A 10/1981 Clark
4,438,532 A 3/1984 Campanella et al.
(Continued)

FOREIGN PATENT DOCUMENTS

GB 281910 A 12/1927

OTHER PUBLICATIONS

International Search Report, dated May 11, 2017, 6 pages, from PCT/US2017/018922.

*Primary Examiner* — Richale L Quinn
(74) *Attorney, Agent, or Firm* — Fulwider Patton LLP

(57) ABSTRACT

A glove formed from a stretchable material for the purpose of increasing grip strength and protecting and supporting the wearers hand. The glove has a first finger stall, a second finger stall, and a thumb aperture, and is formed from a stretchable material that keeps the fingers in the first finger stall and the second finger stall tightly compressed to protect each from injury, and to increase the strength of two fingers being tightly compressed together. The thumb extends out of the thumb aperture and is free to move independently of the first finger stall and the second finger stall in order to allow the thumb freedom of movement and not be locked together with either of the finger stalls.

24 Claims, 9 Drawing Sheets

(56) References Cited

U.S. PATENT DOCUMENTS 4,445,507 A 5/1984 Eisenberg
4,514,861 A 5/1985 Kamada
4,524,464 A 6/1985 Primiano et al.
4,689,828 A * 9/1987 Brewer ..... A41D 13/087 2/21
4,700,405 A 10/1987 Sternberg
4,720,875 A 1/1988 Latina et al.
4,858,246 A 8/1989 Wiggins
4,967,419 A * 11/1990 Elliott ..... A41D 13/08 2/16
5,027,439 A 7/1991 Spector
5,058,209 A 10/1991 Eisenberg
5,367,711 A 11/1994 Calagui
5,561,856 A 10/1996 Pesco
5,590,421 A 1/1997 Craner
5,641,316 A 6/1997 Bakalis et al.
5,689,828 A * 11/1997 Mah ..... A63B 71/148 2/16
5,704,065 A 1/1998 Feuerhake
5,787,896 A 8/1998 Sackett
5,848,440 A 12/1998 Pajarola
5,933,863 A * 8/1999 Monsue ..... A61F 13/104 2/159
5,991,926 A 11/1999 Lakusiewicz
6,052,828 A 4/2000 Widdemer et al.
6,195,804 B1 3/2001 Fraser
D446,610 S 8/2001 Rosenberg
6,691,315 B1 * 2/2004 Clarke ..... A41D 19/01523 2/18
6,698,027 B2 3/2004 Park
6,715,152 B2 4/2004 Mazzarolo
6,732,377 B1 5/2004 Wilkinson
6,745,403 B2 * 6/2004 Sajovic ..... A41D 19/01547 2/161.1
7,055,177 B2 * 6/2006 Svrcek ..... A41D 13/087 2/163
D581,100 S * 11/2008 Stalter ..... D29/113
7,530,120 B2 * 5/2009 Morrow ..... A63B 71/143 2/161.1
7,735,153 B1 * 6/2010 Romiti ..... A41D 19/01558 2/161.6
7,895,671 B2 * 3/2011 Salomon ..... A41D 13/087 2/161.2
D701,650 S * 3/2014 McKee ..... D29/117.1
9,003,569 B2 * 4/2015 Ramirez ..... A41D 19/01547 2/163
9,022,873 B2 * 5/2015 Ramirez ..... A41D 27/28 473/205
9,055,774 B2 * 6/2015 Gambordella ... A41D 19/01547
9,067,126 B2 * 6/2015 Lucero ..... A63D 15/105
9,113,664 B2 * 8/2015 Copeland ..... A63B 71/143
9,884,241 B2 * 2/2018 Ramirez ..... A63B 71/141
2002/0029401 A1 3/2002 McEvoy
2004/0060096 A1 * 4/2004 Thiruppathi ..... A41D 13/088 2/161.1
2004/0107476 A1 * 6/2004 Goldwitz ..... A41D 19/015 2/159
2004/0186402 A1 9/2004 Bennett
2006/0218689 A1 10/2006 Brown
2007/0079421 A1 * 4/2007 Davis ..... A63B 69/00 2/163
2008/0282445 A1 11/2008 Taliento et al.
2009/0025120 A1 * 1/2009 Vestling ..... A41D 19/015 2/161.1
2009/0183295 A1 * 7/2009 Rhee ..... A63B 71/143 2/161.2
2009/0260129 A1 10/2009 Elkowitz
2011/0041235 A1 2/2011 Harris
2011/0099676 A1 * 5/2011 Getzwiller ..... A41D 13/06 2/16
2011/0113521 A1 * 5/2011 Bradford ..... A41D 19/01582 2/19
2011/0179550 A1 7/2011 Watanabe
2012/0031938 A1 * 2/2012 Ballew ..... A63B 71/12 224/267
2012/0204319 A1 8/2012 Gambordella

* cited by examiner

ATHLETIC SUPPORT GLOVE

BACKGROUND

The present invention relates generally to gloves for supporting the hand and improving grip strength and to enhance protection for the fingers and hands. Or particularly, the gloves of the present invention are designed to help athletes maximize their grip strength while enhancing the support of the fingers and hand.

There are numerous gloves designed to support the hand and fingers, and to enhance grip strength especially in sports. Generally, individually designed gloves are targeted to specific sports such as football, baseball, hockey, martial arts, wrestling, cycling and other sports. Many glove designs provide support and protection to the athletes hands to prevent injury such as when throwing or catching a baseball, throwing or catching a football, blocking or grasping in football, weight lifting, or throwing punches in martial arts or boxing. Other glove designs improve grasping power by increasing the friction of the outer surface of the glove. None of the prior art gloves combines the features of increasing the grip strength of the fingers by pairing the fingers together using an elastomeric material, and allowing the freedom of the fingers and the hand to move in order to enhance performance in a particular sport. The present invention meets these needs.

SUMMARY OF THE INVENTION

The present invention is a glove, and more particularly a sports glove, formed from a single piece of elastomeric material that provides an increase in grip strength as well as protecting the fingers and hands from injury. In one embodiment, the glove is formed from a stretchable material and has a front surface and a back surface. A first finger stall and a second finger stall extend from the back surface and the front surface, and a thumb aperture is positioned on the front surface. An exit aperture exists in both the first finger stall and the second finger stall. The thumb aperture is positioned on the front surface of the glove directly below the first finger stall and no portion of the thumb aperture is positioned on the back surface of the glove. In order to enhance the strength and durability of the thumb aperture, a strip of material is folded over the rim of the thumb aperture to sandwich the rim of the thumb aperture with the strip of material, which is then stitched in place. A slit in the front surface extends from the rim forming the thumb aperture to enable the strip of material to be added to the thumb aperture. The slit is then stitched closed in order to add strength and durability to the surrounding area. In one embodiment, an active seam or overlock seam is used to close the slit. In one embodiment, the front surface is attached to the back surface by a single side seam. At least one of the first finger stall and the second finger stall is tapered with the narrower end near the exit aperture. In one embodiment, at least one of or both of the first finger stall and the second finger stall are formed from a double thickness of the stretchable material. In one embodiment, the front surface and back surface extend to form a wrist portion, which also can have a double thickness of the elastic material to support the wrist area. Transverse stitching reinforces the double thickness material in the wrist portion. In one embodiment, at least one of the first finger stall and the second finger stall have transverse stitching to reinforce the first or second finger stall. In another embodiment, a friction enhancing material is attached to the front surface.

The stretchable material forming the glove includes a blend of an elastic material and a non-elastic material. In one embodiment, the blend of material consists of 5% to 40% of the elastic material and 60% to 95% of the non-elastic material. In one embodiment, the stretchable material of the glove is formed from 20% to 24% SPANDEX® and from 76% to 80% nylon, and having a weight in the range from 190 GSM to 250 GSM.

In one embodiment, the glove is formed from a stretchable material and has a front surface and a back surface. A first finger stall extends from the back surface and the front surface, and a thumb aperture is positioned on the front surface. An exit aperture exists in the first finger stall. A second finger stall and a third finger stall extend from the front and back surface and are substantially shorter in length than the first finger stall. The index finger and middle finger go into the first finger stall, the ring finger goes into the second finger stall, and the pinky finger goes into the third finger stall. The thumb aperture is positioned on the front surface of the glove directly below the first finger stall and no portion of the thumb aperture is positioned on the back surface of the glove. In order to enhance the strength and durability of the thumb aperture, a strip of material is folded over the rim of the thumb aperture to sandwich the rim of the thumb aperture with the strip of material, which is then stitched in place. A slit in the front surface extends from the rim forming the thumb aperture to enable the strip of material to be added to the thumb aperture. The slit is then stitched closed in order to add strength and durability to the surrounding area. In one embodiment, an active seam or overlock seam is used to close the slit. At least one of the first finger stall and the second finger stall is tapered with the narrower end near the exit aperture. In one embodiment, at least one of the first finger stall, the second finger stall and the third finger stall are formed from a double thickness of the stretchable material. In one embodiment, at least one of the first finger stall, the second finger stall, or the third finger stall have transverse stitching to reinforce the first or second finger stall. In another embodiment, a friction enhancing material is attached to the front surface.

In one embodiment, the glove is formed from a stretchable material and has a front surface and a back surface. A first finger stall, a second finger stall, and a third finger stall extend from the back surface and the front surface, and a thumb aperture is positioned on the front surface. An exit aperture exists in each stall. The first finger stall receives the index finger, the second finger stall receives the middle finger, and the third finger stall receives both the ring and pinky fingers. The first and second finger stalls are substantially shorter in length than the third finger stall. The thumb aperture is positioned on the front surface of the glove directly below the first finger stall and no portion of the thumb aperture is positioned on the back surface of the glove. In order to enhance the strength and durability of the thumb aperture, a strip of material is folded over the rim of the thumb aperture to sandwich the rim of the thumb aperture with the strip of material, which is then stitched in place. A slit in the front surface extends from the rim forming the thumb aperture to enable the strip of material to be added to the thumb aperture. The slit is then stitched closed in order to add strength and durability to the surrounding area. In one embodiment, an active seam or overlock seam is used to close the slit. At least one of the first finger stall, the second finger stall and the third finger stall is tapered with the narrower end near the exit aperture. In one embodiment, at least one of the first finger stall, the second finger stall, and the third finger stall is formed from a double thickness of the stretchable material. In one embodiment, at least one of the first finger stall, the second finger stall, and the third finger stall has transverse stitching to reinforce the stall. In another embodiment, a friction enhancing material is attached to the front surface.

In one embodiment, the glove is formed from a stretchable material and has a front surface and a back surface. A first finger stall, a second finger stall, and a third finger stall extend from the back surface and the front surface, and a thumb aperture is positioned on the front surface. An exit aperture exists in each stall. The first finger stall receives the index finger, the second finger stall receives the middle finger and ring finger, and the third finger stall receives the pinky finger. The first and third finger stalls are substantially shorter in length than the second finger stall. The thumb aperture is positioned on the front surface of the glove directly below the first finger stall and no portion of the thumb aperture is positioned on the back surface of the glove. In order to enhance the strength and durability of the thumb aperture, a strip of material is folded over the rim of the thumb aperture to sandwich the rim of the thumb aperture with the strip of material, which is then stitched in place. A slit in the front surface extends from the rim forming the thumb aperture to enable the strip of material to be added to the thumb aperture. The slit is then stitched closed in order to add strength and durability to the surrounding area. In one embodiment, an active seam or overlock seam is used to close the slit. At least one of the first finger stall, the second finger stall, and third finger stall is tapered with the narrower end near the exit aperture. In one embodiment, at least one of the first finger stall, the second finger stall, and the third finger stall is formed from a double thickness of the stretchable material. In one embodiment, at least one of the first finger stall, the second finger stall, and the third finger stall have transverse stitching to reinforce the stall. In another embodiment, a friction enhancing material is attached to the front surface.

DETAILED DESCRIPTION OF THE PREFERRED EMBODIMENTS

Figure 1:
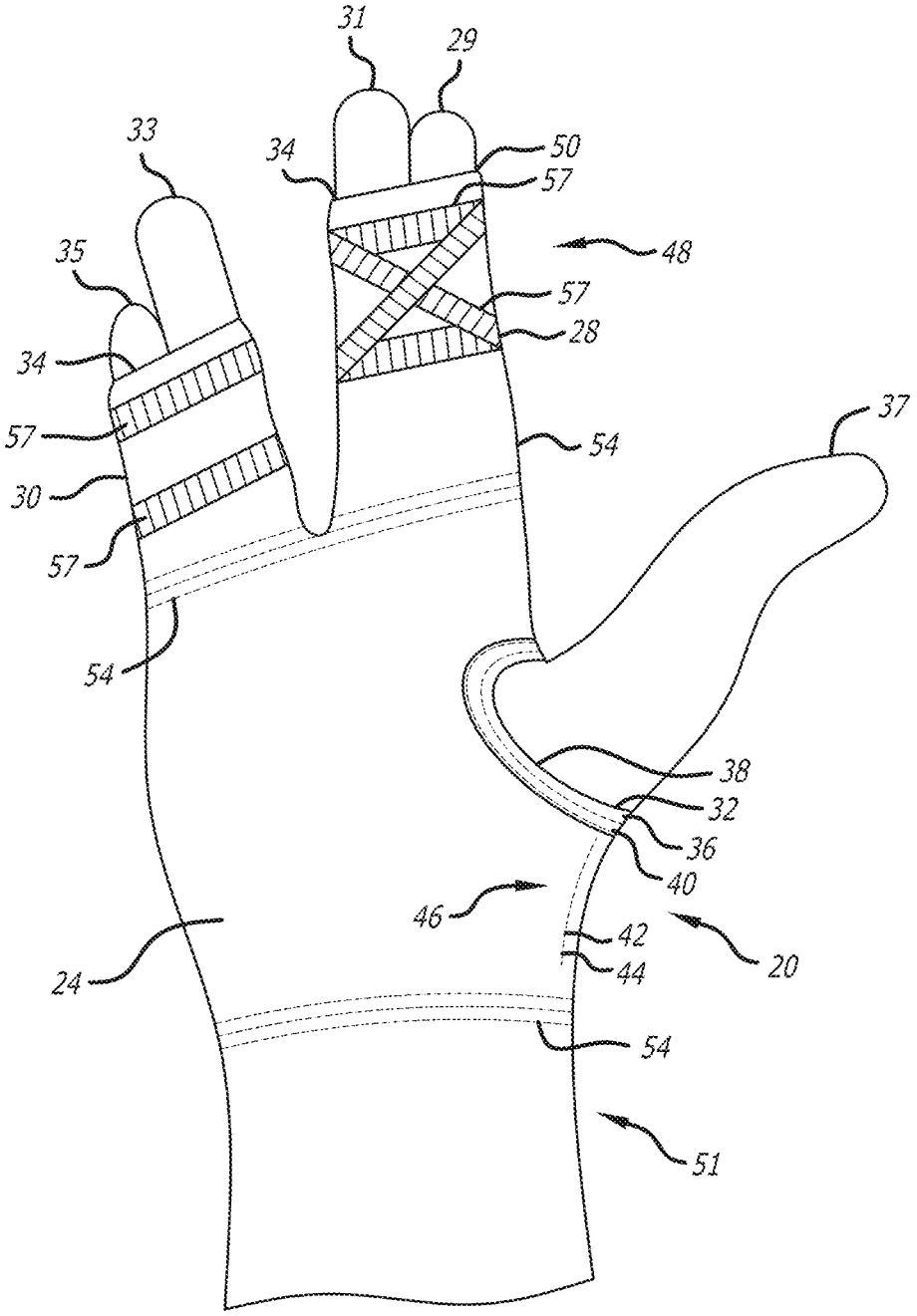
FIG. 1 is a plan view of the glove showing a thumb aperture, and first stall for receiving the index and middle fingers, and a second finger stall for receiving the ring finger and pinky finger.
Figure 2:
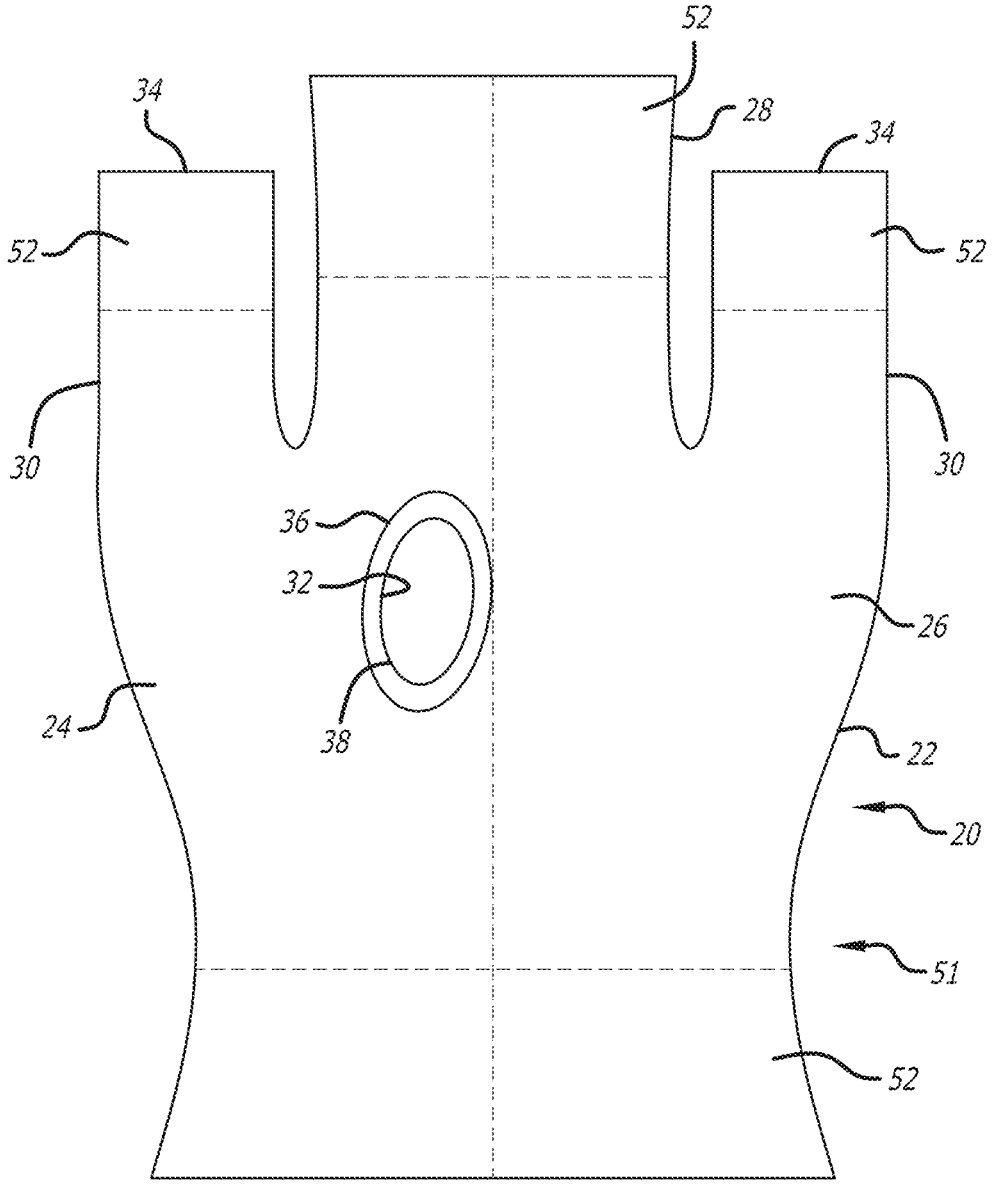
FIG. 2 is a plan view of the glove prior to being folder together and sewn along a side seam to form the finger stalls and the thumb aperture as shown in FIG. 1.
Figure 3:
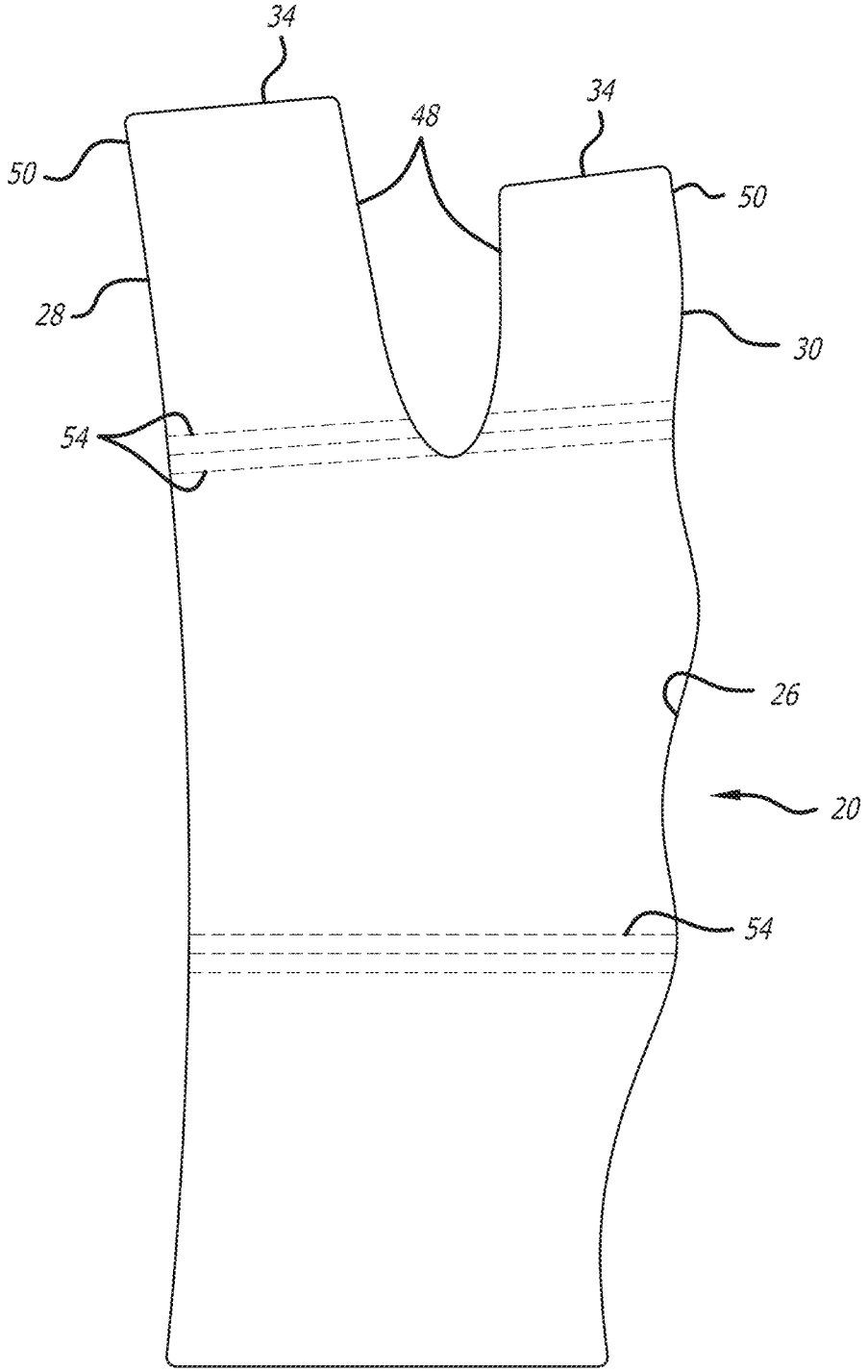
FIG. 3 is a plan view of the back surface of the glove depicting the first finger stall and the second finger stall.
Figure 4:
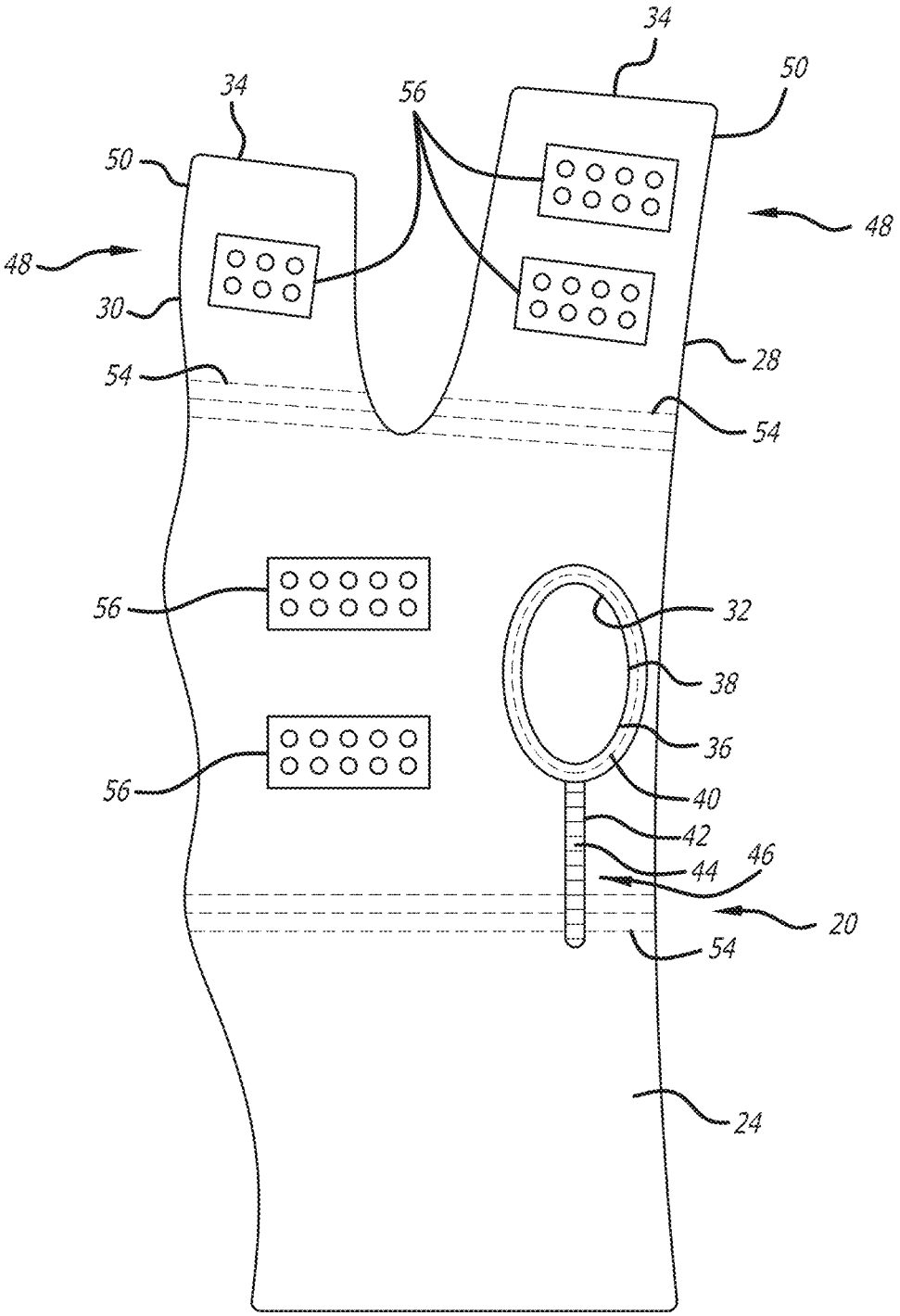
FIG. 4 is a plan view of the front surface of the glove depicting the first finger stall, the second finger stall and the thumb aperture.

In keeping with the invention as shown in FIGS. 1-8, a glove 20, and more particularly a sports glove, is formed from a single piece of elastomeric material 22 that provides an increase in grip strength as well as protecting the fingers and hands from injury. In one embodiment, the glove 20 is formed from a stretchable material and has a front surface 24 and a back surface 26. A first finger stall 28 and a second finger stall 30 extend from the back surface and the front surface, and a thumb aperture 32 is positioned on the front surface. An exit aperture 34 exists in both the first finger stall and the second finger stall. The index finger 29 and middle finger 31 go into the first finger stall 28 and extend out of the exit aperture 34. The ring finger 33 and the pinky finger 35 go into the second finger stall 30 and extend out of exit aperture 34. The thumb aperture 32 is positioned on the front surface 24 of the glove directly below the first finger stall 28 and no portion of the thumb aperture is positioned on the back surface of the glove. It is intended that the entire thumb 37 extend out of the thumb aperture 32. In order to enhance the strength and durability of the thumb aperture, a strip of material 36 is folded over the rim 38 of the thumb aperture to sandwich the rim of the thumb aperture with the strip of material, which is then stitched 40 in place. A slit 42 in the front surface 24 extends from the rim 38 forming the thumb aperture 32 to enable the strip of material to be added to the thumb aperture. The slit is then stitched closed 44 in order to add strength and durability to the surrounding area. In one embodiment, any of an active seam 46, cover stitch or overlock seam is used to close the slit. In one embodiment, the front surface 24 is attached to the back surface 26 by a single side seam 58. At least one of the first finger stall and the second finger stall is tapered 48 with the narrower end 50 near the exit aperture 34. In one embodiment, the front surface and back surface extend to form a wrist portion 51, which also can have a double thickness of the elastic material to support the wrist area. Transverse stitching reinforces the double thickness material in the wrist portion. In one embodiment, at least one of or both of the first finger stall and the second finger stall and the wrist position 51 are formed from a double thickness 52 of the stretchable material. In one embodiment, at least one of the first finger stall and the second finger stall have transverse stitching 54 to reinforce the first or second finger stall. In another embodiment, a friction enhancing material 56 is attached to the front surface either by stitching it to the front surface or by using an adhesive. The friction enhancing material will help prevent the glove from sliding on a wrestling mat for example, and will increase the friction between the glove and any contact surface, including human body parts. The friction enhancing material can include any well-known material such as silicone, urethane, or rubber material.

The stretchable material forming the glove 20 shown in FIGS. 1-8 includes a blend of an elastic material and a non-elastic material. In one embodiment, the blend of material consists of 5% to 40% of the elastic material and 60% to 95% of the non-elastic material. In one embodiment, the stretchable material of the glove is formed from 20% to 24% SPANDEX® and from 76% to 80% nylon, and having a weight in the range from 190 GSM to 250 GSM.

As shown in FIG. 1, it may be desirable to reinforce the finger stalls to add more support. Optionally, support strips 57 are attached to the glove 20, and in particular on the first finger stall and the second finger stall 30. The support strips wrap all the way around the finger stalls and are positioned between where the knuckles are on the fingers. In other words, the support strips are not intended to wrap around the knuckles so that the fingers can bend freely. In one embodiment, the support strips crisscross to enhance support. The support strips can be formed from any material such as cloth, or the same material from which the glove is formed. The support strips can be permanently attached to the glove by stitching or be removable using VELCRO® or a similar material. The support strips can be made from an elastomeric material similar to that forming the glove in order to locally increase compression in the finger stalls.

Figure 5:
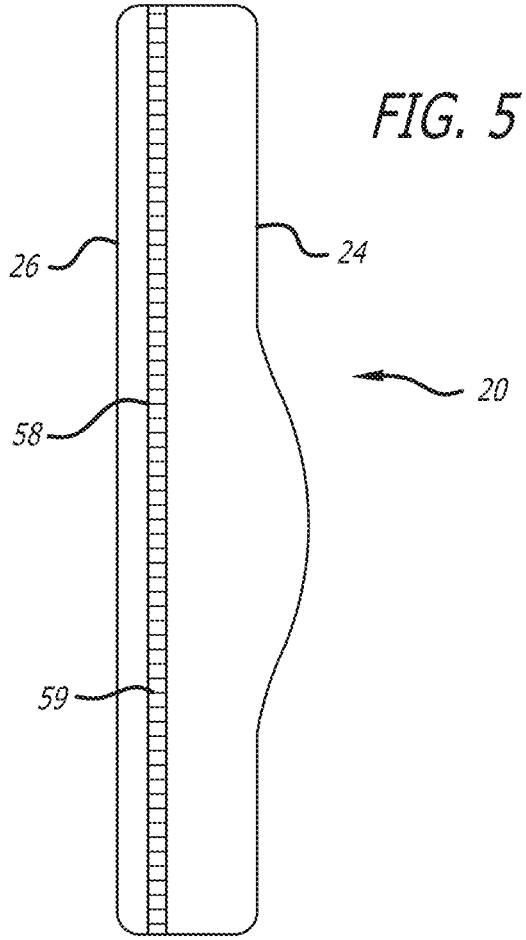
FIG. 5 is a plan view of the left side of the glove depicting a side seam for connecting the front surface to the back surface.
Figure 6:
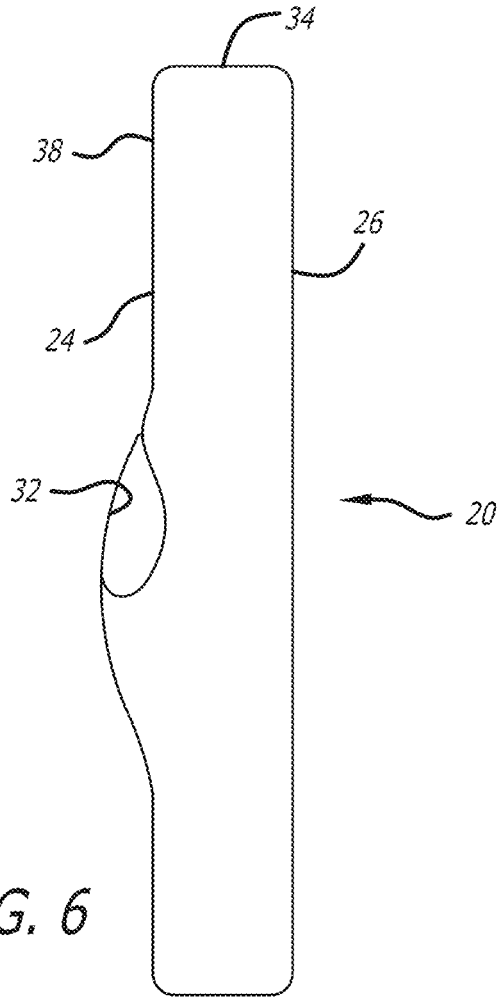
FIG. 6 is a plan view of the right side of the glove depicting the first finger stall and a partial view of the thumb aperture.
Figure 7:
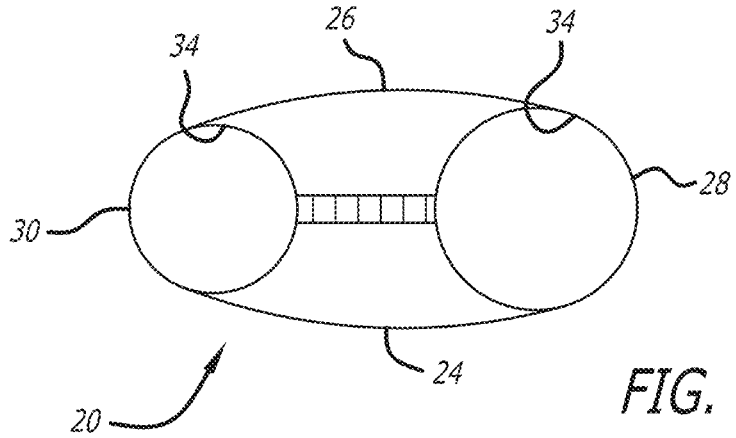
FIG. 7 is a top view of the glove depicting the first finger stall and the second finger stall as well as the front and back surfaces.
Figure 8:
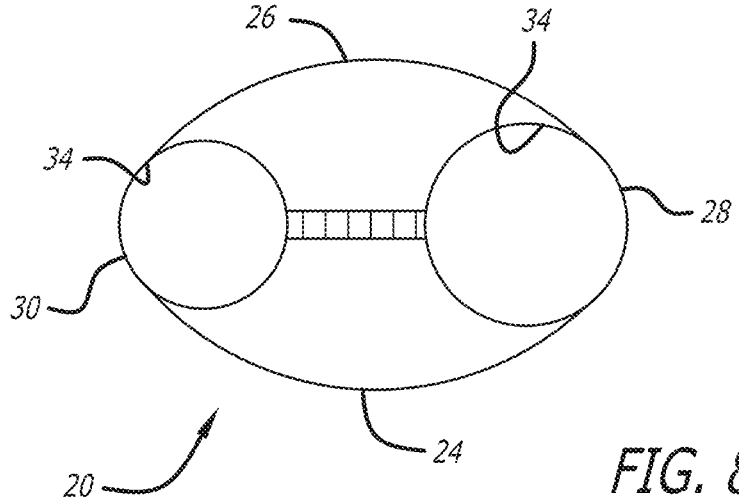
FIG. 8 is a bottom view looking thru the bottom of the glove towards the finger stalls and depicting the first finger stall and the second finger stall as well as the front and back surfaces.

As shown more clearly in FIG. 5, a single side seam 58 is used to join the front surface 24 and the back surface 26. The single side seam can be any of a cover stitch 59, active seam or overlock seam.

Figure 9:
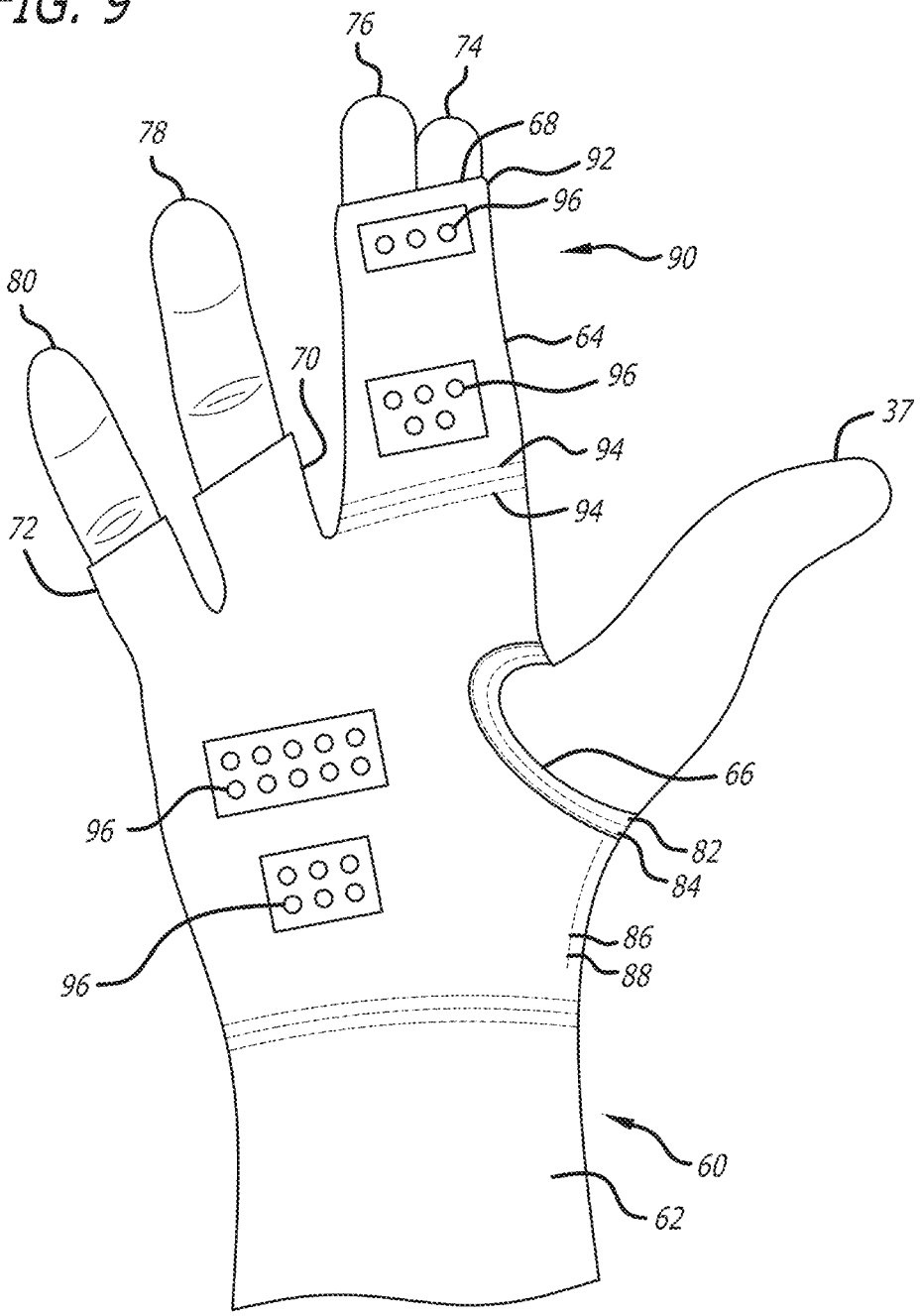
FIG. 9 is a plan view of the front surface of the glove depicting a first finger stall and apertures for the ring finger and the pinky finger as well as a thumb aperture.

In another embodiment shown in FIG. 9, the glove 60 is formed from a stretchable material and has a front surface 62 and a back surface. A first finger stall 64 extends from the back surface and the front surface, and a thumb aperture 66 is positioned on the front surface. An exit aperture 68 exists in the first finger stall. A second finger stall 70 and a third finger stall 72 extend from the front and back surface and are substantially shorter in length than the first finger stall. The index finger 74 and middle finger 76 go into the first finger stall, the ring finger 78 goes into the second finger stall, and the pinky finger 80 goes into the third finger stall. The thumb aperture 66 is positioned on the front surface of the glove directly below the first finger stall 64 and no portion of the thumb aperture is positioned on the back surface of the glove. In order to enhance the strength and durability of the thumb aperture, a strip of material 82 is folded over the rim of the thumb aperture to sandwich the rim of the thumb aperture with the strip of material, which is then stitched 84 in place. A slit 86 in the front surface extends from the rim forming the thumb aperture to enable the strip of material to be added to the thumb aperture. The slit is then stitched closed in order to add strength and durability to the surrounding area. In one embodiment, any of an active seam 88, cover stitch or overlock seam is used to close the slit. At least one of the first finger stall 64 and the second finger stall 70 is tapered 90 with the narrower end 92 near the exit aperture. In one embodiment, at least one of the first finger stall, the second finger stall and the third finger stall are formed from a double thickness of the stretchable material. In one embodiment, at least one of the first finger stall and the second finger stall have transverse stitching 94 to reinforce the first or second finger stall. In another embodiment, a friction enhancing material 96 (similar to that in FIG. 4) is attached to the front surface.

Figure 10:
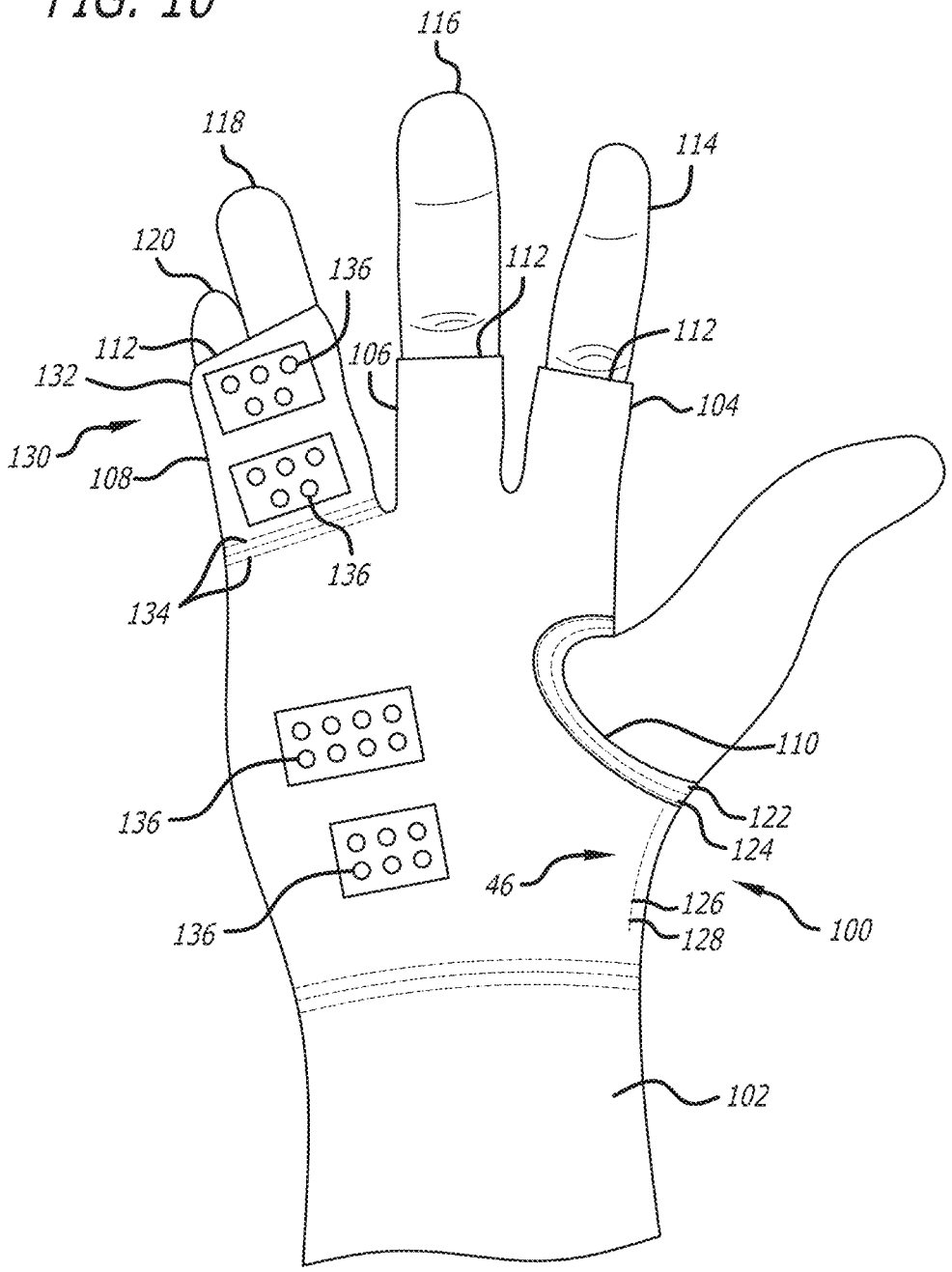
FIG. 10 is a plan view of the glove depicting a second finger stall and finger apertures for the index finger and the middle finger as well as the thumb aperture.

In the embodiment shown in FIG. 10, the glove 100 is formed from a stretchable material and has a front surface 102 and a back surface. A first finger stall 104, a second finger stall 106, and a third finger stall 108 extend from the back surface and the front surface, and a thumb aperture 110 is positioned on the front surface. An exit aperture 112 exists in each stall. The first finger stall receives the index finger 114, the second finger stall receives the middle finger 116, and the third finger stall receives both the ring finger 118 and pinky finger 120. The first and second finger stalls are substantially shorter in length than the third finger stall. The thumb aperture is positioned on the front surface of the glove directly below the first finger stall and no portion of the thumb aperture is positioned on the back surface of the glove. In order to enhance the strength and durability of the thumb aperture, a strip of material 122 is folded over the rim of the thumb aperture to sandwich the rim of the thumb aperture with the strip of material, which is then stitched 124 in place. A slit 126 in the front surface extends from the rim forming the thumb aperture to enable the strip of material to be added to the thumb aperture. The slit is then stitched closed in order to add strength and durability to the surrounding area. In one embodiment, any of an active seam 128, cover stitch or overlock seam is used to close the slit. At least one of the first finger stall, the second finger stall or the third finger stall is tapered 130 with the narrower end 132 near the exit aperture. In one embodiment, at least one of the first finger stall, the second finger stall, and the third finger stall is formed from a double thickness of the stretchable material. In one embodiment, at least one of the first finger stall, the second finger stall, and the third finger stall has transverse stitching 134 to reinforce the stall. In another embodiment, a friction enhancing material 136 is attached to the front surface.

Figure 11:
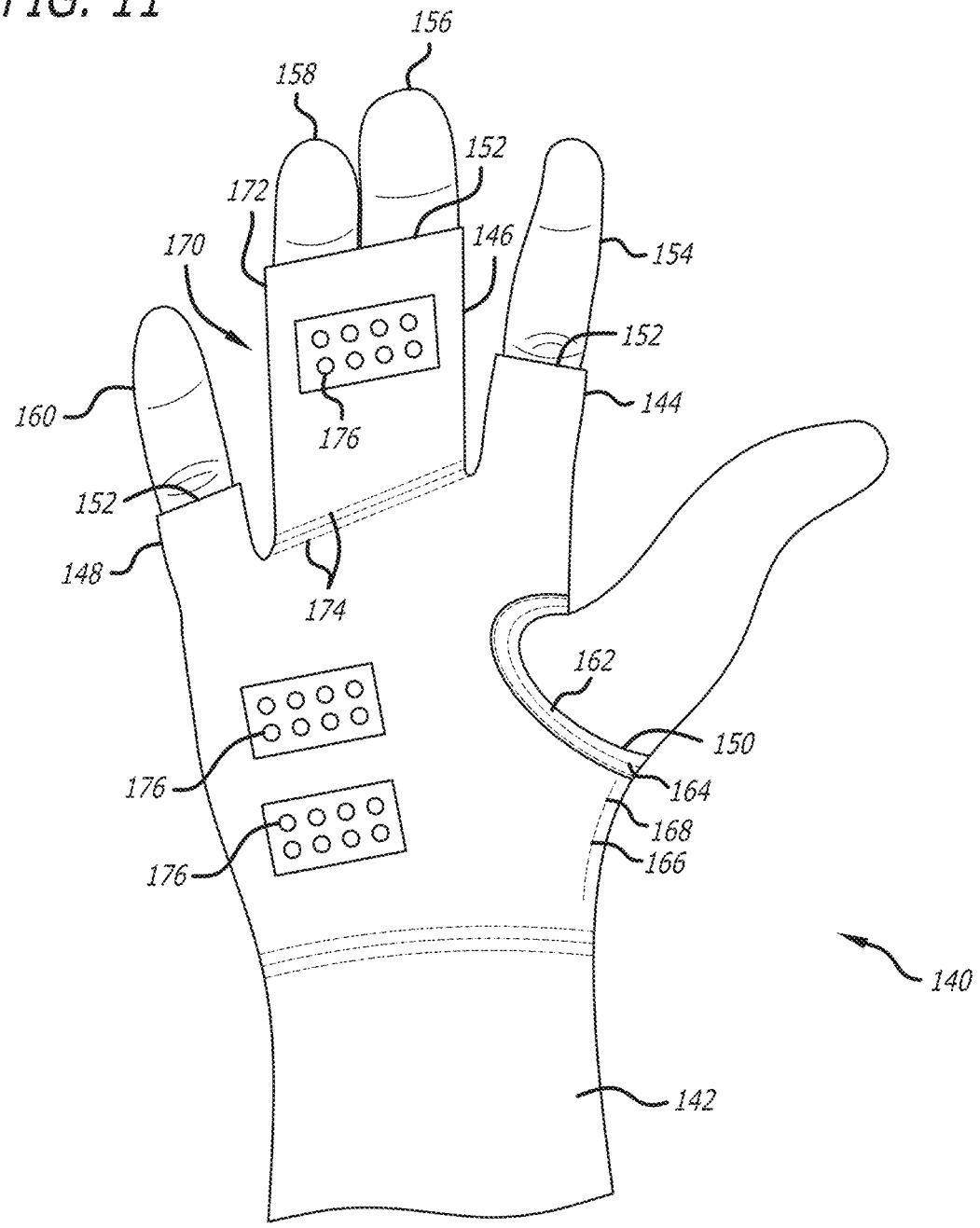
FIG. 11 is a plan view of the glove depicting a single finger stall for receiving the middle and ring finger.

In the embodiment shown in FIG. 11, the glove 140 is formed from a stretchable material and has a front surface 142 and a back surface. A first finger stall 144, a second finger stall 146, and a third finger stall 148 extend from the back surface and the front surface, and a thumb aperture 150 is positioned on the front surface. An exit aperture 152 exists in each stall. The first finger stall receives the index finger 154, the second finger stall receives the middle finger 156 and ring finger 158, and the third finger stall receives the pinky finger 160. The first and third finger stalls are substantially shorter in length than the second finger stall. The thumb aperture is positioned on the front surface of the glove directly below the first finger stall and no portion of the thumb aperture is positioned on the back surface of the glove. In order to enhance the strength and durability of the thumb aperture, a strip of material 162 is folded over the rim of the thumb aperture to sandwich the rim of the thumb aperture with the strip of material, which is then stitched 164 in place. A slit 166 in the front surface extends from the rim forming the thumb aperture to enable the strip of material to be added to the thumb aperture. The slit is then stitched closed in order to add strength and durability to the surrounding area. In one embodiment, any of an active seam 168, cover stitch or overlock seam is used to close the slit. At least one of the first finger stall, the second finger stall, and third finger stall is tapered 170 with the narrower end 172 near the exit aperture. In one embodiment, at least one of the first finger stall, the second finger stall, and the third finger stall is formed from a double thickness of the stretchable material. In one embodiment, at least one of the first finger stall, the second finger stall, and the third finger stall have transverse stitching 174 to reinforce the stall. In another embodiment, a friction enhancing material 176 is attached to the front surface.

In the preceding detailed description, reference to specific embodiments were described. It will, however, be evident that various modifications and changes may be made thereto without departing from the broader spirit and scope of the appended claims. The specification and drawings are, accordingly, to be regarded in an illustrative rather than a restrictive sense.

I claim:

1. A glove, comprising:

a glove formed from a stretchable material and having a front surface and a back surface;

only a first finger stall and a second finger stall extend from the back surface and the front surface, each of the first finger stall and the second finger stall being sized to each receive two fingers;

a first support strip and a second support strip attached to the first finger stall and the second finger stall, the first support strip and the second support strip being spaced apart and wrapped all the way around the first finger stall and the second finger stall and configured for being positioned on either side of the knuckles on the fingers so that the fingers are held together but can bend freely at the knuckles;

wherein a third support strip and a fourth support strip criss-cross to form an X-shaped pattern between the first support strip and the second support strip;

a thumb aperture positioned on the front surface; and an exit aperture in both the first finger stall and the second finger stall so that at least a portion of the fingers extend out of the exit aperture of the first finger stall and the second finger stall.

2. The glove of claim 1, wherein the front surface and the back surface are is formed from a single piece of material.

3. The glove of claim 2, wherein the thumb aperture is positioned on the front surface directly below the first finger stall and no portion of the thumb aperture is positioned on the back surface.

4. The glove of claim 3, wherein a strip of material is attached to a rim forming the thumb aperture.

5. The glove of claim 4, wherein the strip of material is folded over the rim to sandwich the rim with the strip of material.

6. The glove of claim 5, wherein a slit in the front surface extends from the rim forming the thumb aperture.

7. The glove of claim 6, wherein an active seam or overlock seam close the slit.

8. The glove of claim 1, wherein at least one of the first finger stall and the second finger stall is tapered with a narrower end at the exit aperture.

9. The glove of claim 1, wherein at least one of the first finger stall and the second finger stall are formed from a double thickness of stretchable material.

10. The glove of claim 1, wherein at least one of the first finger stall and the second finger stall have transverse stitching to reinforce the first or second finger stall.

11. The glove of claim 1, wherein a friction enhancing material is attached to the front surface.

12. The glove of claim 1, wherein the stretchable material forming the glove includes a blend of an elastic material and a non-elastic material.

13. The glove of claim 12, wherein the blend of material consists of 5% to 40% of the elastic material and 60% to 95% of the non-elastic material.

14. The glove of claim 1, wherein the front surface is attached to the back surface by a single seam.

15. A glove, comprising:

a glove formed from a stretchable material and having a front surface and a back surface only a first finger stall and a second finger stall attached to the front surface and the back surface, each of the first finger stall and the second finger stall being sized to receive two fingers;

a first support strip and a second support strip attached to the first finger stall and the second finger stall, the first support strip and the second support strip being spaced apart and wrapped all the way around the first finger stall and the second finger stall and being positioned on either side of the knuckles on the fingers so that the fingers are held together but can bend freely at the knuckles;

wherein a third support strip and a fourth support strip criss-cross to form an X-shaped pattern between the first support strip and the second support strip;

a thumb aperture in the front surface only, the thumb aperture having a reinforced rim; and an exit aperture in both the first finger stall and the second finger stall so that at least a portion of the fingers extend out of the exit aperture so that at least a portion of the fingers extend out of the exit aperture of the first finger stall and the second finger stall.

16. The glove of claim 15, wherein the reinforced rim of the thumb aperture is formed by a strip of material.

17. The glove of claim 15, wherein the stretchable material forming the glove is formed from 20% to 24% elastic fibers and from 76% to 80% nylon and having a weight in the range from 190 GSM to 250 GSM.

18. The glove of claim 15, wherein a reinforcing stitching extends transversely across the first finger stall and the second finger stall.

19. The glove of claim 15, wherein the front surface is attached to the back surface by a single seam.

20. The glove of claim 15, wherein each of the first finger stall and the second finger stall are formed from two layers of stretchable material.

21. The glove of claim 1, wherein the first support strip and the second support strip are removably attached to the first finger stall and the second finger stall.

22. The glove of claim 21, wherein the first support strip and the second support strip are formed from the stretchable material.

23. The glove of claim 15, wherein the first support strip and the second support strip are removably attached to the first finger stall and the second finger stall.

24. The glove of claim 23, wherein the first support strip and the second support strip are formed from the stretchable material.

* * * * *